US006948224B2

(12) United States Patent
Coombs et al.

(10) Patent No.: US 6,948,224 B2
(45) Date of Patent: Sep. 27, 2005

(54) AUTOMATIC STAPLING METHOD AND STAPLER

(75) Inventors: Peter M. Coombs, Tustin, CA (US); Søren Dybdal, Birkerod (DK)

(73) Assignee: Gradco (Japan) Ltd (JP)

( * ) Notice: Subject to any disclaimer, the term of this patent is extended or adjusted under 35 U.S.C. 154(b) by 235 days.

(21) Appl. No.: 10/428,185

(22) Filed: May 2, 2003

(65) Prior Publication Data

US 2004/0218955 A1 Nov. 4, 2004

(51) Int. Cl.[7] ..... B27F 7/17

(52) U.S. Cl. ..... 29/407.01; 29/407.05; 29/432.1; 29/707; 29/708; 29/714; 29/798; 227/5; 270/52.18; 270/58.09

(58) Field of Search ..... 29/407.01, 407.05, 29/407.09, 407.1, 707, 708, 709, 714, 716, 798, 432.1, 816, 818; 227/1, 5, 119, 7, 131; 270/52.18, 58.09

(56) References Cited

U.S. PATENT DOCUMENTS

| | | | | | |
|---|---|---|---|---|---|
| 4,420,071 | A | * | 12/1983 | Seki | 192/134 |
| 4,720,033 | A | * | 1/1988 | Olesen | 227/131 |
| 5,009,355 | A | * | 4/1991 | Akizawa et al. | 227/114 |
| 5,195,671 | A | * | 3/1993 | Shimomura et al. | 227/5 |
| 5,413,266 | A | * | 5/1995 | Jairam | 227/129 |
| 5,595,336 | A | * | 1/1997 | Everdyke | 227/7 |
| 5,657,918 | A | * | 8/1997 | Shimomura et al. | 227/7 |
| 6,216,935 | B1 | * | 4/2001 | Oussani et al. | 227/6 |
| 2001/0002385 | A1 | * | 5/2001 | Hakozaki et al. | 227/155 |

FOREIGN PATENT DOCUMENTS

| | | | | |
|---|---|---|---|---|
| JP | 10272608 A | * | 10/1998 | B27F/7/21 |

* cited by examiner

*Primary Examiner*—Jermie E. Cozart

(74) *Attorney, Agent, or Firm*—Cohen Sakaguchi & English LLP

(57) ABSTRACT

An automatic stapling apparatus and method is disclosed which may have a stapling mechanism moved by a stapler engaging mechanism into a stapling position in relation to a stack of sheets to be stapled, inserted through a stack insertion opening, and adapted to staple a stack of sheets up to a maximum thickness, and may comprise: a sheet stack thickness gauging apparatus adapted to move into a sheet stack thickness gauging position prior to the stapling mechanism being moved by the stapler engaging mechanism into the stapling position; the sheet stack thickness gauging apparatus being further adapted to engage any object within the insertion opening in position to be engaged by the stapler which is of a thickness greater than or equal to a pre-selected thickness; and, a safety disconnect apparatus adapted to prevent the operation of the stapler in the event that the sheet stack thickness gauging apparatus engages an object in the insertion opening in position to be engaged by the stapler which is of a thickness greater than or equal to the pre-selected thickness. The apparatus and method may further comprise the safety disconnect apparatus being adapted to prevent the operation of the stapler engaging mechanism. The sheet stack thickness gauging apparatus may further comprise: a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position.

35 Claims, 3 Drawing Sheets

AUTOMATIC STAPLING METHOD AND STAPLER

FIELD OF THE INVENTION

The present invention relates to mechanisms for automatically stapling stacks of sheets inserted into the stapler, which may be associated with, e.g., an image producing machine, having an opening, e.g., in the side of the housing of the image producing machine for the insertion manually of a stack of sheets to be stapled by the stapler associated with automatically stapling stacks of sheets as part of the finishing and stacking of the sheets containing images produced by the image producing machine, e.g., a copier or printer.

BACKGROUND OF THE INVENTION

It is well known in the art to provide set finishing apparatus for machines that produce sheets of paper or other image receiving materials, e.g., printers and copiers, which can position a finishing apparatus, e.g., a stapler, in a plurality of locations, as desired. It is also well known to have one of the plurality of set finishing locations be a manual stapling position. The manual stapling position may be, as is known, an automatic stapling position with a variety of different types of sensors that can determine that a stack of sheets has been inserted manually into, e.g., an opening in the side of, e.g., the housing of the set finishing and stacking apparatus and to automatically engage the stapling mechanism. Automatic stapling apparatus and methods of this type are also well known to have engagement mechanism, that, when activated, e.g., move the stapling apparatus into engaging contact or even into compressing contact with the stack of sheets to be stapled prior to activating the stapling apparatus itself to drive the staple through the engaged/compressed stack of sheets.

Typically, this opening is designed for a maximum thickness of the stack of sheets, depending, e.g., on the stapling apparatus capabilities and/or the maximum staple size. In addition, it is well known that it is undesirable for an operator to be able to insert a body part, e.g., a finger into the opening and have the automatic stapling device activate with consequent injury to the inserted body part. In the past, this has been prevented, e.g., by the use of a stack insertion guide and body part shield that is at once large enough for the maximum thickness of sheets for which the automatic stapling apparatus is designed, and yet small enough to keep out the undesired body parts, e.g., a finger, a thumb, etc. As the capabilities of the automatic staplers in use have increased, however, e.g., up to a capability of stapling sheets as thick as around five or six millimeters, and the size of the openings in such shields have remained at about that thickness to keep out, e.g., a seven or eight millimeter body part, the difficulties in inserting the stack of sheets at about the maximum design thickness has increased.

It is, therefore, desirable to have an automatic stapling apparatus that removes these and other shortcomings of the prior art.

SUMMARY OF THE PRESENT INVENTION

An automatic stapling apparatus and method is disclosed which may have a stapling mechanism moved by a stapler engaging mechanism into a stapling position in relation to a stack of sheets to be stapled, inserted through a stack insertion opening, and adapted to staple a stack of sheets up to a maximum thickness, and may comprise: a sheet stack thickness gauging apparatus adapted to move into a sheet stack thickness gauging position prior to the stapling mechanism being moved by the stapler engaging mechanism into the stapling position; the sheet stack thickness gauging apparatus being further adapted to engage any object within the insertion opening in position to be engaged by the stapler which is of a thickness greater than or equal to a pre-selected thickness; and, a safety disconnect apparatus adapted to prevent the operation of the stapler in the event that the sheet stack thickness gauging apparatus engages an object in the insertion opening in position to be engaged by the stapler which is of a thickness greater than or equal to the pre-selected thickness. The apparatus and method may further comprise the safety disconnect apparatus being adapted to prevent the operation of the stapler engaging mechanism. The sheet stack thickness gauging apparatus may further comprise: a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapler which is of greater than or equal to the pre-selected thickness induces movement in the safety gate lever in other than the pivotal direction, thereby actuating the safety disconnect apparatus. The aparatus and method may further comprise the safety gate lever further comprising: an angled lever arm having a first leg and a second leg joined at a corner formed by the junction of the first leg and the second leg; a pivotal mounting slot positioned generally at the corner and adapted to engage a pivot pin; the first leg extending toward the insertion opening and having a safety gate lever arm extension extending across the insertion opening in the region of the stapler operation; the second leg arm co-acting with an eccentric cam forming a portion of the stapler engaging mechanism to pivot the angled lever arm until the first leg reaches a position where the safety gate lever arm extension defines an available opening in the insertion opening equal in thickness to the pre-selected thickness; and, in the event that the safety gate lever arm extension engages an object in the insertion opening having a thickness greater than the pre-selected thickness the second pivoting arm co-acting with the eccentric cam to linearly move the angled lever arm such that the pivot pin travels along the pivotal mounting slot from a pivoting end position. The safety disconnect apparatus may be actuated in response to the pivot pin leaving the pivoting end position. The pre-selected thickness may be essentially equal to the maximum thickness.

DETAILED DESCRIPTION OF A PREFERRED EMBODIMENT

Figure 1:
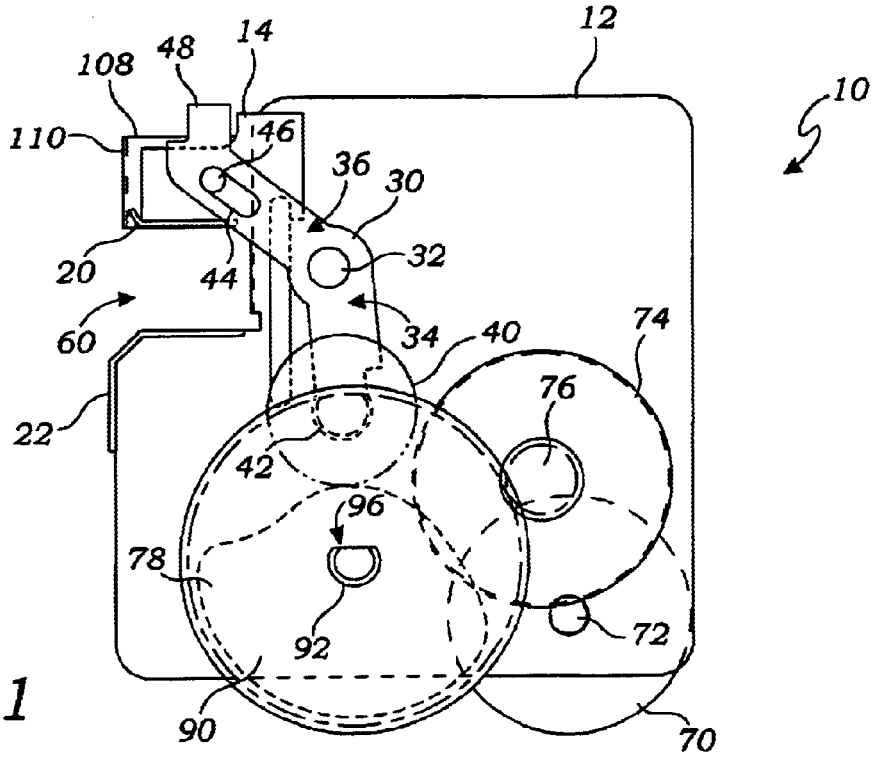
FIG. 1 shows a plan side view of an embodiment of the present invention.

Turning now to FIG. 1 there is shown an automatic stapler assembly 10 according to a disclosed embodiment of the present invention. The automatic stapler assembly can include a frame 12 to which may be mounted a stapler, e.g., an electric stapler 14. The frame 12 and the housing (not shown) of, e.g., a stacking and finishing apparatus (not shown) for, e.g., a printer or copier (not shown) may form an insertion opening 60, as is well known in the art. The insertion opening 60 may be defined at its top and bottom by an upper sheet stack insertion guide 20 and a lower sheet stack insertion guide 22. The upper sheet stack insertion guide may be attached to the stapler 14 for movement with the stapler 14. The lower sheet stack insertion guide 22 may be formed attached to or integral with frame 12.

A stapler positioning lever arm pivot pin 32, connected to the frame 12 may form a pivoting mounting for a stapler positioning lever 30. The stapler positioning lever 30 may be formed in generally an angled form with generally a forty-five degree angle formed between a lower stapler positioning lever arm 34 and an upper stapler positioning lever arm 36. The lower stapler positioning lever arm may have at its terminal end a stapler positioning lever roller 40, which may be rotationally attached to the lower stapler positioning lever arm 34 by a rotational mounting 42. It will be understood that the stapler positioning lever arm 30 may comprise two essentially identical stapler positioning lever arms 30 on either side of the stapler 14, in which event, the rotational mounting 42 may be in the form of a shaft extending between the two stapler positioning lever arms 30.

Figure 4:
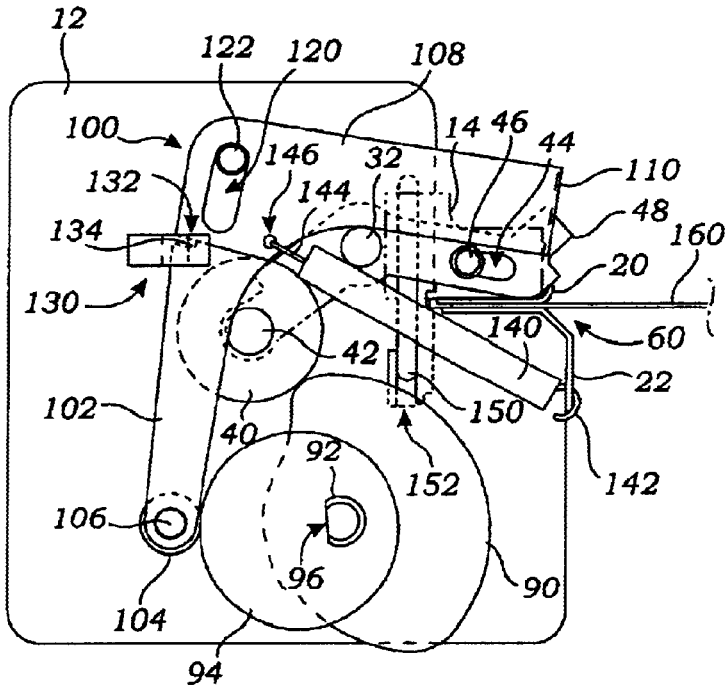
FIG. 4 shows a plan side view as shown in FIG. 3, with the stapling apparatus engaging and stapling a relatively thin stack of sheets.
Figure 5:
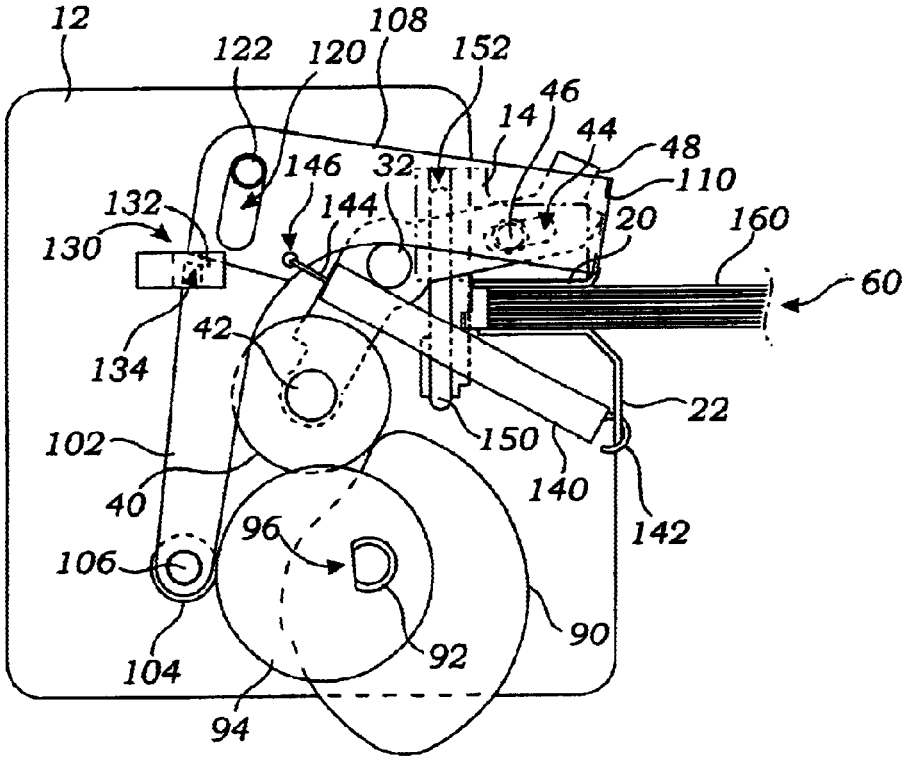
FIG. 5 shows a plan side view as shown in FIG. 3, with the stapling apparatus engaging and stapling a relatively thicker, and essentially maximally thick, stack of sheets and with the safety gate lever in is maximum safe position; and, FIG. 6 shows a plan side view as shown in FIG. 3, with the stapling apparatus as yet to engage and with the safety gate lever having engaged an object in the stapling opening thicker than the designed maximum and thereby moving to cause the stapling apparatus to abort engagement by the stapler.

The upper stapler positioning lever arm 36 may have an upper stapler positioning arm slot 44 formed therein which may receive a stapler positioning pin 46, which may be attached to the stapler 14 for sliding motion within the upper stapler positioning arm slot as the stapler positioning lever arm 30 moves the stapler from a home position as shown, e.g., in FIG. 1 to one of a plurality of engaging positions, e.g., as shown in FIG. 4 or FIG. 5. The upper stapler positioning lever arm 36 may have a crown 48, which in the case of there being two opposingly situated stapler positioning arm levers 30 on opposing sides of the stapler 14, may for a connection between the two upper stapler positioning lever arms 36, as is shown in more detail in FIG. 2.

Figure 2:
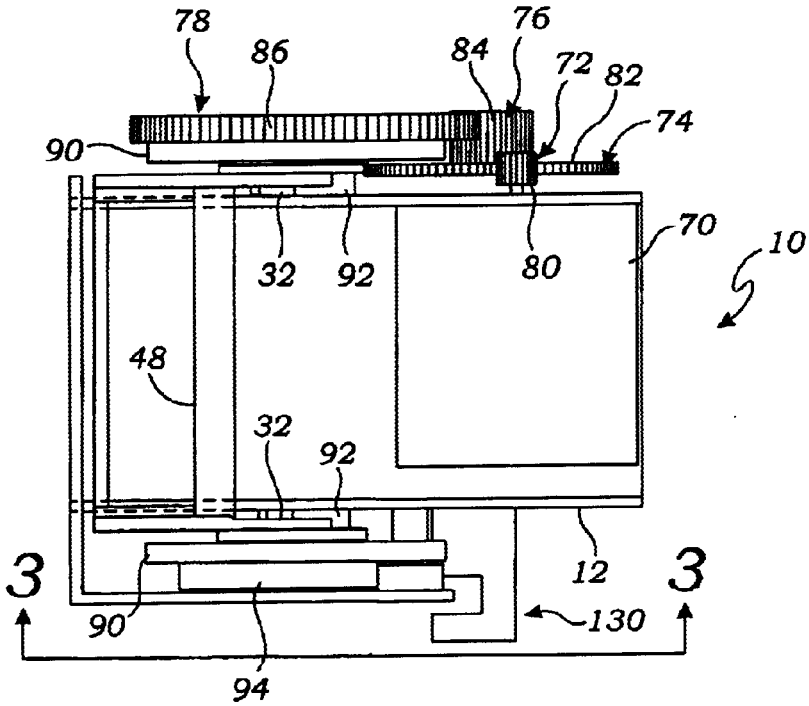
FIG. 2 shows a plan top view of the embodiment of the present invention as shown in FIG. 1.

Turning now to FIG. 2, there is shown a top plan view of the disclosed embodiment of the present invention 10 as shown in FIG. 1. The automatic stapler 10 according to the disclosed embodiment of FIG.'S 1 and 2 may have a motor 70 which may be mounted to the frame, e.g., by mounting brackets (not shown) and may have an output drive shaft with an output drive shaft gear 72, having drive shaft gear teeth 80. The output drive shaft drive gear 72 may engage the teeth 82 of an intermediate reduction gear 74. The intermediate reduction gear 74 may have an intermediate reduction gear shaft 76, which may include intermediate reduction gear teeth 84. The intermediate reduction gear shaft teeth 84 may in turn engage the teeth 86 of a reduction gear 78.

As is shown in more detail in FIG. 1, the reduction gear 78 may be mounted on a shaft 92 along with a stapler positioning/engagement mechanism operating cam 90. The stapler positioning/engagement operating mechanism cam shaft 92 may have a flat side 96 onto which is slotted the stapler positioning/engagement mechanism operating cam 90 and the reduction gear 78. It will be understood, that the reduction gear 78 and the stapler positioning/engagement mechanism operating cam 90 may be separate entities slotted onto the flattened shaft 92, or may be integrally formed, e.g., from the same piece of molded plastic, with, e.g., the stapler positioning/engagement operating cam 90 raised up from one side of the reduction gear 78, and with each sharing the same central opening for the flat sided shaft 92.

Figure 3:
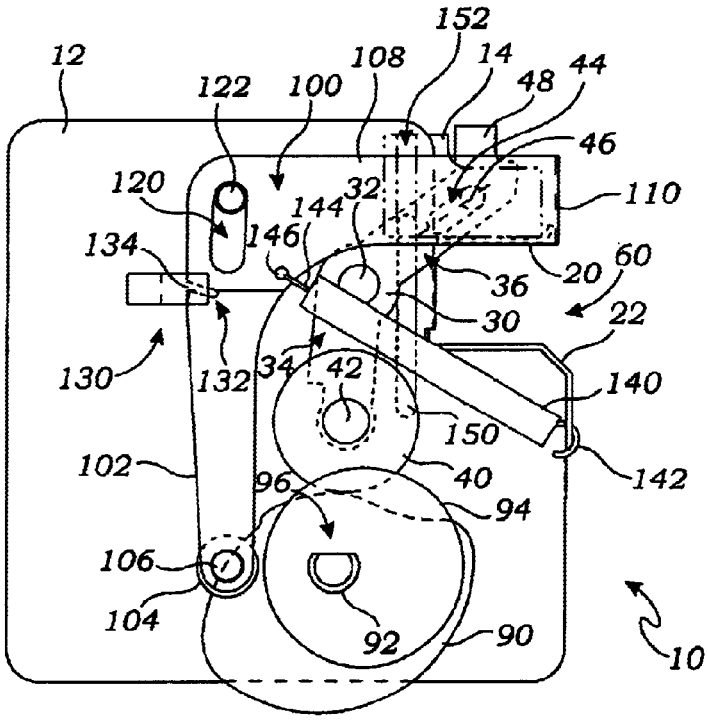
FIG. 3 shows a plan side view of the embodiment of the present invention from the view indicated by lines 3—3 in FIG. 2, the opposite side view as that shown in FIG. 1, with components unnecessary to the understanding of the function of the presently illustrated embodiment not shown, and with the gate lever mechanism in a home position and the stapler not engaged.

Turning now to FIG. 3, there is shown a plan side view of the embodiment of the present invention from the view indicated by lines 3—3 in FIG. 2, the opposite side view as that shown in FIG. 1, with components unnecessary to the understanding of the function of the presently illustrated embodiment not shown. Mounted on the same stapler positioning/engagement mechanism operating shaft 92 may be a safety gate operating mechanism cam 94, which may be positioned off center on the shaft 92.

A safety gate lever mechanism 100 may be pivotally mounted to the frame 12, e.g., by a safety gate lever operating mechanism pivot pin 122. The safety gate operating mechanism lever 100 may be formed generally in an angled configuration having generally a ninety degree angle formed between a lower safety gate lever arm 102 and an upper safety gate lever arm 108. The lower safety gate operating mechanism lever arm 102 may have at its distal end a safety gate operating mechanism lever arm roller 104 which may be mounted, e.g., by a rotational mounting 106 to the distal end of the lower safety gate operating mechanism lever arm 102. The upper safety gate operating mechanism lever arm 108 may have formed at its distal end an extension which may extend across the front of the stapler 14 in the vicinity of the insertion opening 60. It will be understood that the safety gate operating mechanism lever arm 100 may be formed as a pair of such lever arms 100 on opposing sides of the stapler 14, in similar fashion to the stapler positioning levers 30, in which event, the extension 100 can join the two opposingly placed safety gate operating mechanism lever arms 100. In either event, the extension 110, as explained below, can form the safety gate.

The pivotal attachement of the safety gate operating mechanism lever arm(s) 100 to the frame by pivot pin 122 may be accomplished by a pivot pin mounting slot 120 formed, e.g., in the upper safety gate operating mechanism lever arm 108. As shown in FIG. 3, the lower safety gate operating mechanism lever arm 102 and the upper safety gate operating mechanism lever arm 108 may be separate pieces joined together, e.g., by spot welding or the like, or may be formed as a single angled piece. Also present in the safety gate operating mechanism lever 100 is a safety gate sensor slot 132, which co-acts with a safety gate lever position sensor 130, which may include a safety gate position sensor optical sensing unit 134. In this embodiment, the safety gate position sensing slot 132 is shown to be formed in the lower safety gate operating mechanism lever arm 102, however, other locations will be understood to be possible as well.

Also shown in FIG. 3 is a coil spring assembly including a coil spring 140, which may be attached to the housing 12 by a coil spring lower mounting hook 142 and may be attached to the safety gate positioning mechanism lever 100 by an upper coil spring mounting hook 144, which may extent through a hole 146 formed generally at the intersection of the upper safety gate operating mechanism lever arm 108 and the lower safety gate operating mechanism lever arm 102. The coil spring 140 can serve to spring bias the safety gate operating mechanism lever 100 to a home position, as depicted in FIG. 3, when not under the influence of the safety gate operating mechanism cam 94, as more fully explained below. The stapler 14 may be guided in its movement from the position shown, e.g., in FIG. 3 to an engaging position by a stapler positioning guide member 150 slideably engaged within a stapler positioning guide slot 152.

Turning now to FIG. 4 there is shown a plan side view as shown in FIG. 3, with the stapler 14 having been moved into a position by the stapler positioning apparatus positioning lever 30 to a position where the stapler 14 is engaging and stapling a relatively thin stack of sheets 160. It will be understood by those skilled in the art that the stapler 14 in this position as shown in FIG. 4 may not only be engaging the stack of sheets 160, but may serve to compress the sheets 160 together before and/or during the stapling operation. The stapling operation may be understood by those in the art to occur under the control of a controller, with the stapler 14 being electrical in operation and a control signal energized to provide electrical power to the stapler 14 when in a selected desired position, as is well known in the art, and not illustrated in detail in this application.

Also illustrated in FIG. 4 is the positioning of the safety gate lever 100. In this position of the stapler positioning mechanism operating cam 90 and the safety gate positioning operating cam 94, the stapler positioning mechanism positioning lever 30 is in its furthest rotated position about the stapler positioning lever pivot pin 32 at which point the stapler 14 has been displaced from its home position essentially the maximum distance that it can be displaced into an engaging/compressing position for stapling the relatively shin stack of sheets 160. In addition, the safety gate positioning mechanism lever 100 has been displaced in pivoting motion about the safety gate positioning lever pivot pin 122 essentially as far as it can under the influence of the positioning mechanism operating cam 94. The safety gate lever 100 remains in pivoting relation to the pivot pin 122 engaging the upper end of the pivot pin slot 120. In addition, the safety gate lever positioning sensor remains in a position with the safety gate lever position sensor optical sensing unit still in the safety gate lever sensor positioning slot. The safety gate 110, as shown in FIG. 4, remains above the horizontally extending portion of the lower sheet stack insertion guide 22 by a pre-selected distance.

Turning now to FIG. 5, there is shown a plan side view as shown in FIG. 3, with the stapler 14 engaging and stapling a relatively thicker, and essentially maximally thick stack of sheets and with the safety gate lever 100 in the same pre-selected position as is shown in FIG. 4. It is to be noted that in this position with essentially the thickest stack of sheets 160 that is possible for the automatic stapling apparatus manual stapling operation to accommodate, the safety gate 110 has been displaced by the movement of the safety gate positioning lever 100 to the same essentially maximum displacement position under the influence of the safety gate position mechanism operating cam 94, which is, as noted above the same position as shown in FIG. 4. This maximally displaced position, as shown in FIG. 5, also coincides, essentially with the safety gate 110 essentially abutting the top of the stack of sheets 160, as shown in FIG. 5. The pivotal movement of the safety gate positioning mechanism lever 100 about the safety gate positioning lever arm pivot pin 122, remains as shown in FIG. 4 and discussed above in relation to FIG. 4. The same is true as to the safety gate positioning sensor optical sensing unit 134 in relation to the safety gate position sensor slot in the safety gate positioning lever 100.

Figure 6:
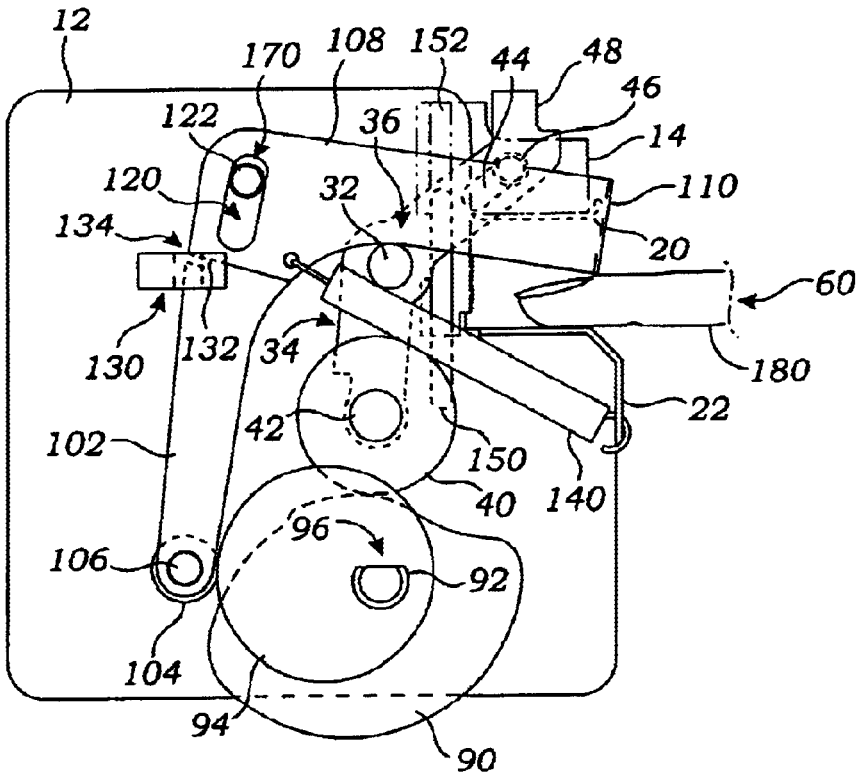

Turning now to FIG. 6 there is shown a plan side view as shown in FIG. 3, with the stapler 14 as yet to have been engaged by the stapler positioning/engagement lever 30 and with the safety gate 100 at the distal end of the upper safety gate positioning lever arm 108 having engaged an object in the insertion opening 60 that is thicker than the designed maximum, and thereby moving to cause the stapling apparatus to abort engagement by the stapler, as will be more fully explained below.

As shown in FIG. 6, where the safety gate 110 at the distal end of the upper safety gate positioning lever arm 108 engages an object in the insertion opening in the vicinity of the stapler 14, such as a finger 180, prior to reaching the pre-selected position of maximal disposition, as shown in FIGS. 4 and 5, the continued translation of the roller 106 at the distal end of the lower safety gate positioning lever arm 102 will serve to cause the safety gate positioning lever 100 to be translated more or less linearly along the axis generally of the safety gate lever pivotal slot 120, as is depicted in FIG. 6. In this manner, the safety gate positioning sensor slot 132 is also displaced generally along this same axis. The result is that, e.g., the optical connection of the safety gate lever position sensor optical sensing unit may be broken and this can send a signal to the controller (not shown) to, e.g., abort continued operation of the motor 70, thereby preventing engagement and operation of the stapler 14 within the insertion opening.

We claim:

1. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging apparatus adapted to move into a sheet stack thickness gauging position prior to the stapling mechanism being moved by the stapling mechanism engaging mechanism into the stapling position;

the sheet stack thickness gauging apparatus being further adapted to engage any object within the insertion opening in position to be engaged by the stapling mechanism which is of a thickness greater than or equal to a pre-selected thickness; and, a safety disconnect apparatus adapted to prevent the operation of the stapler in the event that the sheet stack thickness gauging apparatus engages an object in the insertion opening in position to be engaged by the stapler which is of a thickness greater than or equal to the pre-selected thickness.

2. The apparatus of claim 1, further comprising:

the safety disconnect apparatus being adapted to prevent the operation of the stapler engaging mechanism.

3. The apparatus of claim 2, further comprising:

the sheet stack thickness gauging apparatus further comprising:

a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapling mechanism which is of greater than or equal to the pre-selected thickness induces movement in the safety gate lever in other than the pivotal direction, thereby actuating the safety disconnect apparatus.

4. The apparatus of claim 3 further comprising:

the safety gate lever further comprising:

an angled lever arm having a first leg and a second leg joined at a corner formed by the junction of the first leg and the second leg;

a pivotal mounting slot positioned generally at the corner and adapted to engage a pivot pin;

the first leg extending toward the insertion opening and having a safety gate lever arm extension extending across the insertion opening in the region of the stapler operation;

the second leg arm co-acting with an eccentric cam forming a portion of the stapler engaging mechanism to pivot the angled lever arm until the first leg reaches a position where the safety gate lever arm extension defines an available opening in the insertion opening equal in thickness to the pre-selected thickness; and, in the event that the safety gate lever arm extension engages an object in the insertion opening having a thickness greater than the pre-selected thickness the second pivoting arm co-acting with the eccentric cam to linearly move the angled lever arm such that the pivot pin travels along the pivotal mounting slot from a pivoting end position.

5. The apparatus of claim 4, further comprising:

the safety disconnect apparatus is actuated in response to the pivot pin leaving the pivoting end position.

6. The apparatus of claim 5 wherein the pre-selected thickness is essentially equal to the maximum thickness.

7. The apparatus of claim 1, further comprising:

the sheet stack thickness gauging apparatus further comprising:

a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapling mechanism which is of greater than or equal to the pre-selected thickness induces movement in the safety gate lever in other than the pivotal direction, thereby actuating the safety disconnect apparatus.

8. The apparatus of claim 7 further comprising:

the safety gate lever further comprising:

an angled lever arm having a first leg and a second leg joined at a corner formed by the junction of the first leg and the second leg;

a pivotal mounting slot positioned generally at the corner and adapted to engage a pivot pin;

the first leg extending toward the insertion opening and having a safety gate lever arm extension extending across the insertion opening in the region of the stapler operation;

the second leg arm co-acting with an eccentric cam forming a portion of the stapler engaging mechanism to pivot the angled lever arm until the first leg reaches a position where the safety gate lever arm extension defines an available opening in the insertion opening equal in thickness to the pre-selected thickness; and, in the event that the safety gate lever arm extension engages an object in the insertion opening having a thickness greater than the pre-selected thickness the second pivoting arm co-acting with the eccentric cam to linearly move the angled lever arm such that the pivot pin travels along the pivotal mounting slot from a pivoting end position.

9. The apparatus of claim 8, further comprising:

the safety disconnect apparatus is actuated in response to the pivot pin leaving the pivoting end position.

10. The apparatus of claim 9 wherein the pre-selected thickness is essentially equal to the maximum thickness.

11. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging means moved into a sheet stack thickness gauging position prior to the stapling mechanism being moved by the stapler engaging mechanism into the stapling position;

the sheet stack thickness gauging means including means for engaging any object within the insertion opening in position to be engaged by the stapling mechanism which is of a thickness greater than or equal to a pre-selected thickness; and, a safety disconnect means for preventing the operation of the stapling mechanism in the event that the sheet stack thickness gauging means encounters an object in the insertion opening in position to be engaged by the stapling mechanism which is of a thickness greater than or equal to the pre-selected thickness.

12. The apparatus of claim 11, further comprising:

the safety disconnect means including means for preventing the operation of the stapler engaging mechanism.

13. The apparatus of claim 12, further comprising:

the sheet stack thickness gauging means further comprising:

a safety gate gauging means mounted for movement in conjunction with the operation of a portion of the stapler engaging mechanism prior to the stapling mechanism being moved by the stapler engaging mechanism into the stapling position, for placing the sheet stack thickness gauging means in an operating position; and, wherein engagement by the safety gate gauging means of any object in the insertion opening in a position to be engaged by the stapling mechanism which is of greater than or equal to the pre-selected thickness causes the safety gate gauging means to actuate the safety disconnect means.

14. The apparatus of claim 13 further comprising:

the safety gate gauging means further comprising a safety gate lever further comprising:

an angled lever arm having a first leg and a second leg joined at a corner formed by the junction of the first leg and the second leg;

a pivotal mounting means for pivotally mounting the angled lever arm;

the first leg extending toward the insertion opening and having a safety gate lever arm extension extending across the insertion opening in the region of the stapler operation;

the second leg co-acting with a portion of the stapler engaging mechanism to pivot the angled lever arm until the first leg reaches a position where the safety gate lever arm extension defines an available opening in the insertion opening equal in thickness to the pre-selected thickness; and, sensing means responsive to the safety gate lever arm extension encountering an object in the insertion opening having a thickness greater than the pre-selected thickness for co-acting with the pivotal mounting means to deactivate the stapler engaging mechanism.

15. The apparatus of claim 14, further comprising:

the safety disconnect means is actuated in response to the co-action of the angled lever arm and the pivotal mounting means.

16. The apparatus of claim 15 wherein the pre-selected thickness is essentially equal to the maximum thickness.

17. The apparatus of claim 11, further comprising:

the sheet stack thickness gauging means further comprising:

a safety gate gauging means mounted for movement in conjunction with the operation of a portion of the stapler engaging mechanism prior to the stapling mechanism being moved by the stapler engaging mechanism into the stapling position, for placing the sheet stack thickness gauging means in an operating position; and, wherein engagement by the safety gate gauging means of any object in the insertion opening in a position to be engaged by the stapling mechanism which is of greater than or equal to the pre-selected thickness causes the safety gate gauging means to actuate the safety disconnect means.

18. The apparatus of claim 17 further comprising:

the safety gate gauging means further comprising a safety gate lever further comprising:

an angled lever arm having a first leg and a second leg joined at a corner formed by the junction of the first leg and the second leg;

a pivotal mounting means for pivotally mounting the angled lever arm;

the first leg extending toward the insertion opening and having a safety gate lever arm extension extending across the insertion opening in the region of the stapler operation;

the second leg co-acting with a portion of the stapler engaging mechanism to pivot the angled lever arm until the first leg reaches a position where the safety gate lever arm extension defines an available opening in the insertion opening equal in thickness to the pre-selected thickness; and, sensing means responsive to the safety gate lever arm extension encountering an object in the insertion opening having a thickness greater than the pre-selected thickness for co-acting with the pivotal mounting means to deactivate the stapler engaging mechanism.

19. The apparatus of claim 18, further comprising:

the safety disconnect means is actuated in response to the co-action of the angled lever arm and the pivotal mounting means.

20. The apparatus of claim 19 wherein the pre-selected thickness is essentially equal to the maximum thickness.

21. An automatic stapling method having a stapling mechanism moved by a stapler engaging mechanism into a stapling position in relation to a stack of sheets to be stapled, inserted through a stack insertion opening, for stapling a stack of sheets up to a maximum thickness, including a method for protecting a user, comprising:

employing a sheet stack thickness gauging method prior to the stapling mechanism being moved by the stapler engaging mechanism into the stapling position;

engaging any object within the insertion opening in position to be engaged by the stapling mechanism which is of a thickness greater than or equal to a pre-selected thickness; and, preventing the operation of the stapling mechanism in the event that an object is encountered in the insertion opening in position to be engaged by the stapling mechanism which is of a thickness greater than or equal to the pre-selected thickness.

22. The method of claim 21, further comprising:

the step of preventing the operation of the stapling mechanism comprises preventing the operation of the stapler engaging mechanism.

23. The method of claim 22, further comprising:

the sheet stack thickness gauging method further comprising:

utilizing a safety gate gauging mechanism mounted for movement in conjunction with the operation of a portion of the stapler engaging mechanism prior to the stapling mechanism being moved by the stapler engaging mechanism into the stapling position, thereby enabling gauging of thickness; and, wherein the encountering by the safety gate gauging mechanism of any object in the insertion opening in a position to be engaged by the stapling mechanism which is of greater than or equal to the pre-selected thickness causing the safety gate gauging mechanism to actuate the step of preventing the operation of the stapling mechanism.

24. The method of claim 23 further comprising:

the safety gate gauging mechanism further comprising a safety gate lever further comprising:

an angled lever arm having a first leg and a second leg joined at a corner formed by the junction of the first leg and the second leg;

a pivotal mounting means for pivotally mounting the angled lever arm;

the first leg extending toward the insertion opening and having a safety gate lever arm extension extending across the insertion opening in the region of the stapler operation;

the second leg co-acting with a portion of the stapler engaging mechanism to pivot the angled lever arm until the first leg reaches a position where the safety gate lever arm extension defines an available opening in the insertion opening equal in thickness to the pre-selected thickness; and, sensing means responsive to the safety gate lever arm extension encountering an object in the insertion opening having a thickness greater than the pre-selected thickness for co-acting with the pivotal mounting means to deactivate the stapler engaging mechanism.

25. The method of claim 24, further comprising:

actuating safety disconnect means in response to the co-action of the angled lever arm and the pivotal mounting means.

26. The method of claim 25 wherein the pre-selected thickness is essentially equal to the maximum thickness.

27. The method of claim 21, further comprising:

the sheet stack thickness gauging method further comprising:

utilizing a safety gate gauging mechanism mounted for movement in conjunction with the operation of a portion of the stapler engaging mechanism prior to the stapling mechanism being moved by the stapler engaging mechanism into the stapling position, thereby enabling gauging of thickness; and, wherein the encountering by the safety gate gauging mechanism of any object in the insertion opening in a position to be engaged by the stapling mechanism which is of greater than or equal to the pre-selected thickness causing the safety gate gauging mechanism to actuate the step of preventing the operation of the stapling mechanism.

28. The method of claim 27 further comprising:

the safety gate gauging mechanism further comprising a safety gate lever further comprising:

an angled lever arm having a first leg and a second leg joined at a corner formed by the junction of the first leg and the second leg;

a pivotal mounting means for pivotally mounting the angled lever arm;

the first leg extending toward the insertion opening and having a safety gate lever arm extension extending across the insertion opening in the region of the stapler operation;

the second leg co-acting with a portion of the stapler engaging mechanism to pivot the angled lever arm until the first leg reaches a position where the safety gate lever arm extension defines an available opening in the insertion opening equal in thickness to the pre-selected thickness; and, sensing means responsive to the safety gate lever arm extension encountering an object in the insertion opening having a thickness greater than the pre-selected thickness for co-acting with the pivotal mounting means to deactivate the stapler engaging mechanism.

29. The method of claim 28, further comprising:

actuating safety disconnect means in response to the co-action of the angled lever arm and the pivotal mounting means.

30. The method of claim 29 wherein the pre-selected thickness is essentially equal to the maximum thickness.

31. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging apparatus adapted to move into a sheet stack thickness gauging position prior to the stapling mechanism being moved by the stapler engaging mechanism into the stapling position;

the sheet stack thickness gauging apparatus being further adapted to engage any object within the insertion opening in position to be engaged by the stapling mechanism which is of a thickness greater than or equal to a pre-selected thickness;

a safety disconnect apparatus adapted to prevent the operation of the stapling mechanism in the event that the sheet stack thickness gauging apparatus engages an object in the insertion opening in position to be engaged by the stapling mechanism which is of a thickness greater than or equal to the pre-selected thickness; and, the safety disconnect apparatus being adapted to prevent the operation of the stapler engaging mechanism.

32. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging apparatus adapted to move into a sheet stack thickness gauging position prior to the stapling mechanism being moved by the stapler engaging mechanism into the stapling position;

the sheet stack thickness gauging apparatus being further adapted to engage any object within the insertion opening in position to be engaged by the stapling mechanism which is of a thickness greater than or equal to a pre-selected thickness;

a safety disconnect apparatus adapted to prevent the operation of the stapling mechanism in the event that the sheet stack thickness gauging apparatus engages an object in the insertion opening in position to be engaged by the stapling mechanism which is of a thickness greater than or equal to the pre-selected thickness;

the safety disconnect apparatus being adapted to prevent the operation of the stapler engaging mechanism; and, the sheet stack thickness gauging apparatus further comprising:

a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapling mechanism which is of greater than or equal to the pre-selected thickness induces movement in the safety gate lever in other than the pivotal direction, thereby actuating the safety disconnect apparatus.

33. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging apparatus adapted to move into a sheet stack thickness gauging position prior to the stapling mechanism being moved by the stapler engaging mechanism into the stapling position;

the sheet stack thickness gauging apparatus being further adapted to engage any object within the insertion opening in position to be engaged by the stapling mechanism which is of a thickness greater than or equal to a pre-selected thickness;

a safety disconnect apparatus adapted to prevent the operation of the stapling mechanism in the event that the sheet stack thickness gauging apparatus engages an object in the insertion opening in position to be engaged by the stapling mechanism which is of a thickness greater than or equal to the pre-selected thickness;

the safety disconnect apparatus being adapted to prevent the operation of the stapler engaging mechanism;

the sheet stack thickness gauging apparatus further comprising:

a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapling mechanism which is of greater than or equal to the pre-selected thickness induces movement in the safety gate lever in other than the pivotal direction, thereby actuating the safety disconnect apparatus; and, the safety gate lever further comprising:

an angled lever arm having a first leg and a second leg joined at a corner formed by the junction of the first leg and the second leg;

a pivotal mounting slot positioned generally at the corner and adapted to engage a pivot pin;

the first leg extending toward the insertion opening and having a safety gate lever arm extension extending across the insertion opening in the region of the stapler operation;

the second leg arm co-acting with an eccentric cam forming a portion of the stapler engaging mechanism to pivot the angled lever arm until the first leg reaches a position where the safety gate lever arm extension defines an available opening in the insertion opening equal in thickness to the pre-selected thickness; and, in the event that the safety gate lever arm extension engages an object in the insertion opening having a thickness greater than the pre-selected thickness the second pivoting arm co-acting with the eccentric cam to linearly move the angled lever arm such that the pivot pin travels along the pivotal mounting slot from a pivoting end position.

34. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging apparatus adapted to move into a sheet stack thickness gauging position prior to the stapling mechanism being moved by the stapler engaging mechanism into the stapling position;

the sheet stack thickness gauging apparatus being further adapted to engage any object within the insertion opening in position to be engaged by the stapling mechanism which is of a thickness greater than or equal to a pre-selected thickness;

a safety disconnect apparatus adapted to prevent the operation of the stapling mechanism in the event that the sheet stack thickness gauging apparatus engages an object in the insertion opening in position to be engaged by the stapling mechanism which is of a thickness greater than or equal to the pre-selected thickness;

the safety disconnect apparatus being adapted to prevent the operation of the stapler engaging mechanism;

the sheet stack thickness gauging apparatus further comprising:

a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapling mechanism which is of greater than or equal to the pre-selected thickness induces movement in the safety gate lever in other than the pivotal direction, thereby actuating the safety disconnect apparatus;

the safety gate lever further comprising:

an angled lever arm having a first leg and a second leg joined at a corner formed by the junction of the first leg and the second leg;

a pivotal mounting slot positioned generally at the corner and adapted to engage a pivot pin;

the first leg extending toward the insertion opening and having a safety gate lever arm extension extending across the insertion opening in the region of the stapler operation;

the second leg arm co-acting with an eccentric cam forming a portion of the stapler engaging mechanism to pivot the angled lever arm until the first leg reaches a position where the safety gate lever arm extension defines an available opening in the insertion opening equal in thickness to the pre-selected thickness; and, in the event that the safety gate lever arm extension engages an object in the insertion opening having a thickness greater than the pre-selected thickness the second pivoting arm co-acting with the eccentric cam to linearly move the angled lever arm such that the pivot pin travels along the pivotal mounting slot from a pivoting end position; and, the safety disconnect apparatus is actuated in response to the pivot pin leaving the pivoting end position.

35. An automatic stapling apparatus having a stapling mechanism moved by a stapler engaging mechanism into a stapling position in relation to a stack of sheets to be stapled, inserted through a stack insertion opening, and adapted to staple a stack of sheets up to a maximum thickness, comprising:

a sheet stack thickness gauging apparatus adapted to move into a sheet stack thickness gauging position prior to the stapling mechanism being moved by the stapler engaging mechanism into the stapling position;

the sheet stack thickness gauging apparatus being further adapted to engage any object within the insertion opening in position to be engaged by the stapling mechanism which is of a thickness greater than or equal to a pre-selected thickness;

a safety disconnect apparatus adapted to prevent the operation of the stapling mechanism in the event that the sheet stack thickness gauging apparatus engages an object in the insertion opening in position to be engaged by the stapling mechanism which is of a thickness greater than or equal to the pre-selected thickness;

the safety disconnect apparatus being adapted to prevent the operation of the stapler engaging mechanism;

the sheet stack thickness gauging apparatus further comprising:

a safety gate lever pivotally mounted for pivoting movement about a pivot axis by the operation of a portion of the stapler engaging mechanism prior to the stapling mechanism being moved by the stapler engaging mechanism into the stapling position, up to a point where the sheet stack thickness gauging apparatus is in an operating position; and, wherein engagement by the safety gate lever of any object in the insertion opening in a position to be engaged by the stapling mechanism which is of greater than or equal to the pre-selected thickness induces movement in the safety gate lever in other than the pivotal direction, thereby actuating the safety disconnect apparatus;

the safety gate lever further comprising:

an angled lever arm having a first leg and a second leg joined at a corner formed by the junction of the first leg and the second leg;

a pivotal mounting slot positioned generally at the corner and adapted to engage a pivot pin;

the first leg extending toward the insertion opening and having a safety gate lever arm extension extending across the insertion opening in the region of the stapler operation;

the second leg arm co-acting with an eccentric cam forming a portion of the stapler engaging mechanism to pivot the angled lever arm until the first leg reaches a position where the safety gate lever arm extension defines an available opening in the insertion opening equal in thickness to the pre-selected thickness; and, in the event that the safety gate lever arm extension engages an object in the insertion opening having a thickness greater than the pre-selected thickness the second pivoting arm co-acting with the eccentric cam to linearly move the angled lever arm such that the pivot pin travels along the pivotal mounting slot from a pivoting end position;

the safety disconnect apparatus is actuated in response to the pivot pin leaving the pivoting end position; and, wherein the pre-selected thickness is essentially equal to the maximum thickness.

* * * * *